US008192227B2

(12) United States Patent
Gentner et al.

(10) Patent No.: US 8,192,227 B2
(45) Date of Patent: Jun. 5, 2012

(54) JUMPER CONNECTOR

(75) Inventors: Adam Gentner, Huntington Beach, CA (US); Ray de Schepper, Norwalk, CA (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 13/306,153

(22) Filed: Nov. 29, 2011

(65) Prior Publication Data

US 2012/0072048 A1 Mar. 22, 2012

Related U.S. Application Data

(62) Division of application No. 12/724,900, filed on Mar. 16, 2010, now Pat. No. 8,066,526.

(51) Int. Cl.
*H01R 9/22* (2006.01)

(52) U.S. Cl. ..... 439/511; 439/491; 439/483; 200/51.12; 200/51 R; 200/51.05; 200/51.06

(58) Field of Classification Search .... 200/51.02–51.06, 200/51 R, 51.09, 51.11, 51.12; 439/511, 439/491, 483, 507
See application file for complete search history.

(56) References Cited

U.S. PATENT DOCUMENTS

| | | | | | |
|---|---|---|---|---|---|
| 1,947,798 | A * | 2/1934 | Reinhardt | 439/511 |
| 2,114,273 | A * | 4/1938 | Huppert | 200/51 R |
| 2,660,715 | A * | 11/1953 | Glass et al. | 439/484 |
| 2,717,985 | A * | 9/1955 | Zellner | 439/511 |
| 4,725,698 | A * | 2/1988 | Takai et al. | 200/50.29 |
| 4,885,438 | A * | 12/1989 | Tajima | 200/51.09 |
| 4,945,872 | A * | 8/1990 | Embry | 123/146.5 B |
| 5,282,112 | A * | 1/1994 | Bremer | 361/729 |
| 5,586,908 | A * | 12/1996 | Lorrain | 439/511 |
| 5,931,694 | A * | 8/1999 | Kato et al. | 439/511 |
| 5,971,801 | A * | 10/1999 | Kato et al. | 439/511 |
| 6,483,061 | B1 * | 11/2002 | Harvey et al. | 200/532 |
| 6,495,775 | B2 * | 12/2002 | Lawson et al. | 200/50.28 |
| 6,773,283 | B2 * | 8/2004 | Yoshimatsu et al. | 439/180 |
| 7,232,324 | B2 * | 6/2007 | Oesterhaus | 439/268 |
| 7,578,682 | B1 * | 8/2009 | Hughes et al. | 439/89 |

* cited by examiner

*Primary Examiner* — Gary F. Paumen
(74) *Attorney, Agent, or Firm* — Baker & Hostetler LLP

(57) ABSTRACT

A method and apparatus for jumping a pin connections in an electrical device are provided. The electrical device can be a vehicle having a data link connector that once mated with the apparatus, such a jumping connector that will jump at least two pin connections in the data link connector. The jumping connector can also have dip switches that be in the active or inactive state. In the active state, the dip switch will cause a connection to one of the pin connectors on the electrical device while the inactive state, the dip switch will not cause a connection to one of the pin connectors on the electrical device.

20 Claims, 2 Drawing Sheets

JUMPER CONNECTOR

CROSS-REFERENCE TO RELATED APPLICATIONS

This application claims priority to and is a divisional of pending U.S. patent application entitled, Jumper Connector, filed Mar. 16, 2010, having a Ser. No. 12/724,900, the disclosure of which is hereby incorporated by reference in its entirety.

FIELD OF THE INVENTION

The present invention relates generally to a jumping connector. More particularly, the present invention relates to a jumping connector that jump pins in an electrical device such as an data link connector in vehicle.

BACKGROUND OF THE INVENTION

Many electrical devices includes pins for various connections. Once such connection is included in OBD-II (on-board diagnostic) which is present in vehicles that are 1996 or newer and is used to assist a technician to service as vehicle. The technician connects to the OBD-II through the data link connector (DLC) in the vehicle. The DLC has 16 pins that are used for a variety of function and signals from the various engine control unit (ECU) that are part of the BOD-II.

In order to test certain functionality in a vehicle, such as activating a tire pressure monitoring system, the technician must provide a connection to connect certain pins together in order to activate the desired functionality. However, the ECU's location makes it difficult for the technician to connect the proper pins together, thus can lead to errors in the diagnosis because the desired functionality was not activated.

Accordingly, it is desirable to provide an apparatus that will provide the correct jumper connections for the activation of the desired functionality in an electronic device such as a vehicle.

SUMMARY OF THE INVENTION

The foregoing needs are met, to a great extent, by the present invention, wherein in one aspect an apparatus is provided that in some embodiments that allows for jumping of pin connections in an electrical device.

In accordance with one embodiment of the present invention, a jumper connector is provided, which can include a handle at a first end of the jumper connector, an interface at a second end of the jumper connector, a body positioned between the interface and the handle, and a wire located partially in the interface and configured to jump at least two pin connections in a vehicle data link connector.

In accordance with another embodiment of the present invention, a method of jumping pins in a vehicle data connector is provided, which can include the steps of determining a functionality of a vehicle to activate, determining which pins to jump in order to activate the functionality, attaching a jumper connector having a wire configured to jump the determined pins, and activating the functionality in the vehicle.

In accordance with yet another embodiment of the present invention, a jumper connector is provided, which can include a means for gripping at a first end of the jumper connector, a means for interfacing at a second end of the jumper connector, a means for housing positioned between the means for interfacing and the means for gripping, and a means for connecting located partially in the means for interfacing and configured to jump at least two pin connections in a vehicle data link connector.

In accordance with yet another embodiment of the present invention, a jumper connector is provided, which can include a handle at a first end of the jumper connector, an interface at a second end of the jumper connector, a body positioned between the interface and the handle, and a wire located partially in the interface and configured to jump at least two pin connections in an electrical device.

In accordance with still another embodiment of the present invention, a jumper connector is provided, which can include a handle at a first end of the jumper connector, an interface at a second end of the jumper connector, a body positioned between the interface and the handle, and a plurality of dip switches located partially in the interface and the handle, the plurality of dip switches are configured to jump at least two pin connections in a vehicle data link connector.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 2:
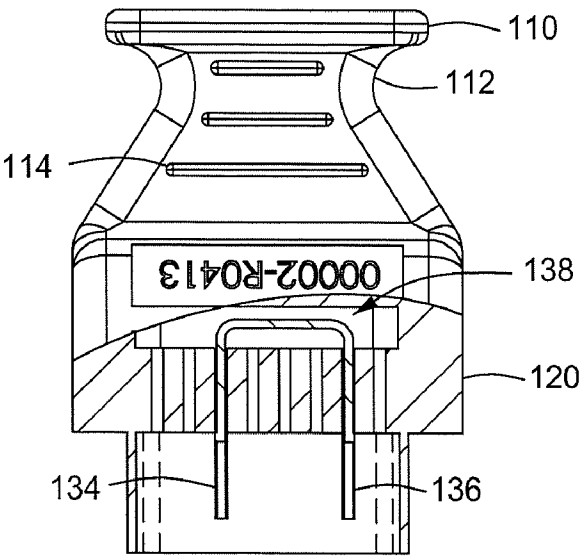
FIG. 2 illustrates a partial cut away of the jumper connector showing the wire and pins according to an embodiment of the invention.

The invention will now be described with reference to the drawing figures, in which like reference numerals refer to like parts throughout. An embodiment in accordance with the present invention provides a method and apparatus that will correctly connect the desired pin connections in order to activate the desired functionality for testing by the technician. Although in the embodiments discussed below are for OBD- II pins connections, any desired jumper connection with pins or the like is also contemplated by the invention.

Figure 1:
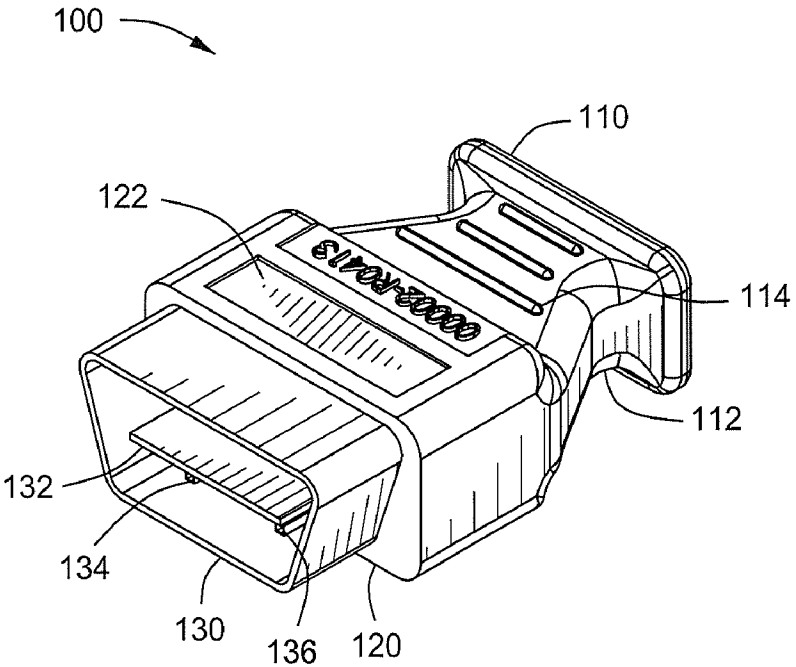
FIG. 1 illustrates a jumper connector 100 according to an embodiment of the invention.

FIG. 1 illustrates a jumper connector 100 according to an embodiment of the invention. The jumper connector 100 includes three main parts, a handle 110, a body 120 and an interface 130. The handle 110 includes an indent portion 112 that is configured and constructed to receive fingers of the technician for connecting or releasing of the jumper connector 100 from the DLC. An end of the handle 110 is generally rectangular in shape, but any shape can be used for the handle. The handle 110 includes raised portions 114 on upper and lower surfaces also configured and constructed to receive fingers thereon for connecting and releasing the jumper connector 100 from the DLC. The raised portions and the indent portions allow for easier connection and release of the jumper connector 100. In various embodiments, the handle may be made of any materials including elastomeric materials. Further, portions of the handle may be made of a soft elastomeric material and other portions may be made with a harder elastomeric material.

In another embodiment, the handle may be colored or otherwise designated by other conventions (numbered, handle shape) so that the technician will know what pins are being jumped by a particular jumper connector 100. A chart may be created for use with the convention so that the technician can know exactly the connections being jumped by the jumper connector 100. This way, the technician can easily scan a drawer (where the jumper connectors may be stored) full of jumper connectors 100 and quickly pick the desired jumper connector 100. In other embodiments, the convention desired can be applied to other portions of the jumper connector or to only that part, such as the body 120 or the interface 130.

In one embodiment, the body 120 is generally larger than the handle 110 and can contain a portion of or all of the jumper portion (see FIG. 2) of the jumper connector 100. The body 120 can include a recessed area 122 on a side of the body 120. The recessed area 122 can be used for a variety of functions including for affixing a logo or name associated with the jumper connector 100. The recessed area 122 can be used for one of the conventions discussed herein, such as putting numbers thereon.

The interface 130 is constructed and designed to fit a complementary interface to which it will be connected to. In this embodiment, the interface 130 is designed to connect to the DLC (not shown) of a vehicle. The interface 130 includes a tab portion 132 to assist the interface 130 to frictionally fit with the DLC.

The interface 130 includes a jumper connection in the form of male pins 134 and 136 connected together via a wire 138 (FIG. 2). Because the pins 134, 136 are connected together, when they are mated to the DLC and their respective female receiving portions, the connection will be jumped. That is, a desired functionality of the vehicle may be activated because certain pins are jumped. In this embodiment, pins conventionally designated 11 & 15 are jumped by the wire. In another embodiment, the pins 134, 136 and the wire 138 may be separate pieces or may be one piece.

Some examples of the functionality that can be activated can include jumping pins 4 & 8 to clear or check DTC (diagnostic trouble code) and pins 4 & 12 to activate test mode procedure for vehicle stability control system. Once the jumper connector is connected to the DLC, then the desired testing can take place.

FIG. 2 illustrates a partial cut away of the jumper connector showing the wire 138 and pins 134, 136 according to an embodiment of the invention. Pins 134, 136 correspond to pins 11 and 15 on the DLC. The remaining pins 1-10, 12-14 and 16 on the jumper connector 100 are absent so that no misconnections are made.

Figure 3:
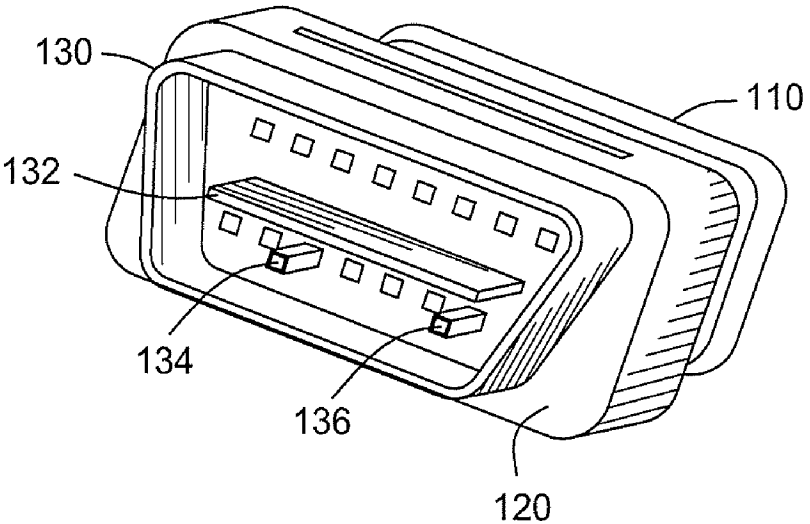
FIG. 3 illustrates a plan view of the jumper connector 100 according to an embodiment of the invention.

FIG. 3 illustrates a plan view of the jumper connector 100 according to an embodiment of the invention. In this view, the pins 134 and 136 are shown which corresponds to pins 11 and 15 on the DLC. With the pins 134 and 136 in place, the technician can use jumper connector 100 to jump pins 11 and 15.

In operation, the technician can determine which functionality in the vehicle he wants to test. Then he can determine which pins that need to be jumped in the DLC in order for that functionality to activate. He then can select the proper jumper connector designated by a convention such as a colored handle. Once the correct jumper connector is selected it can be connected with the DLC and the desired pins on the DLC is jumped. With the pins on the DLC is jumped, then the functionality is activated and can be tested.

Figure 4:
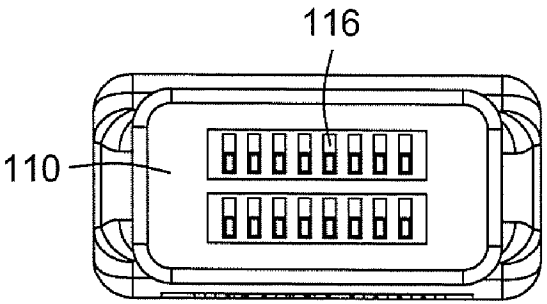
FIG. 4 illustrates an alternative embodiment using switches according to an embodiment of the invention.

FIG. 4 illustrates an alternative embodiment using switches according to an embodiment of the invention. In this embodiment, handle 112 can include dip switches 116 so that the pins may be varied according to the needs of the technician. There can be 16 switches on the handle for each of the pins in the DLC. There can be as little or as many switches as needed. The dip switches 116 can start at a bottom portion (inactive) of the handle and moved to a top portion (active) of the handle.

When the dip switch is in the bottom portion or the inactive state, the corresponding pin in the interface 130 is not active or connected to another pin. When the dip switch is moved to the top portion or the active state, the corresponding pin is in position to be connected to another pin. Thus, in order to connect two pins in the DLC, the corresponding dip switch can be moved into the top portion of the handle while the remaining dip switches remain in the bottom portion of the handle. For example, if the technician wants to jump connections 11 and 15 in the DLC, then he can move the corresponding dip switches to make the jump.

In an alternative embodiment, the jumper connector 100 can have a preventive mechanism that only allows for two dip switches to move into the upper portion of the handle or the active state. With this preventive mechanism, only two pins can be jumped instead of three or more. This will prevent damage to the vehicle that can be caused by having more than two pins being jumped. In another embodiment, the dip switch in the upper portion can be the inactive state while the dip switch in the lower portion can be the active state.

In this embodiment with the dip switches, the jumper connector 100 can be made to be more universal so that less jumper connectors will be needed per garage or per garage bay.

In operation, as above, the technician can determine which functionality in the vehicle he wants to test. Then he can determine which pins that need to be jumped in the DLC in order for that functionality to activate. He then can select the proper dip switches to move into position in order to be active. Once the correct dip switches are moved into the active position, it can be connected with the DLC and the desired pins on the DLC is jumped. With the pins on the DLC is jumped, then the functionality is activated and can be tested.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A jumper connector, comprising:

a handle at a first end of the jumper connector;

an interface at a second end of the jumper connector;

a body positioned between the interface and the handle; and a plurality of dip switches located partially in the interface and the handle, the plurality of dip switches are configured to jump at least two pin connections in a vehicle data link connector.

2. The jumper connector of claim 1, wherein the plurality of switches have an active position and an inactive position.

3. The jumper connector of claim 2, wherein when the plurality of switches is in the active position, then a pin associated with that switch will mate with one of the at least two pin connections.

4. The jumper connector of claim 2, wherein when the plurality of switches is in the inactive position, then a pin associated with that switch will not mate with one of the at least two pin connections.

5. The jumper connector of claim 1, wherein the handle includes raised portions on a surface of the handle, the raised portions are configured to interact with a user's fingers.

6. The jumper connector of claim 1, wherein the interface is constructed to mate with the vehicle data link connector.

7. The jumper connector of claim 1, wherein when the jumper connector is coupled with the vehicle data link connector, it will activate a functionality of the vehicle.

8. The jumper connector of claim 1, wherein the body includes a recessed area on a surface of the body.

9. The jumper connector of claim 1, wherein a portion of the handle is generally rectangular in shape.

10. The jumper connector of claim 1, further comprising an identifier configured to show the user what position the dip switches are in.

11. A method of jumping pins in a vehicle data connector, comprising the steps of:

determining a functionality of a vehicle to activate;

determining which dip switches to adjust in order to activate the functionality;

adjusting determined dip switches; and activating the functionality in the vehicle.

12. The method of jumping pins of claim 11, wherein the determined dip switches are associated with the functionality to activate.

13. The method of jumping pins of claim 11, further comprising visually confirming a setting of the dip switches.

14. A jumper connector, comprising:

means for gripping at a first end of the jumper connector;

means for interfacing at a second end of the jumper connector;

means for housing positioned between the means for interfacing and the means for gripping; and means for switching located partially in the means for interfacing and configured to jump at least two pin connections in a vehicle data link connector.

15. The jumper connector of claim 14, wherein the means for gripping includes raised portions on a surface of the means for gripping, the raised portions are configured to interact with a user's fingers.

16. The jumper connector of claim 14, wherein the means for interfacing is constructed to mate with the vehicle data link connector.

17. The jumper connector of claim 14, wherein when the jumper connector is coupled with the vehicle data link connector, it will activate a functionality of the vehicle.

18. The jumper connector of claim 14, wherein the means for housing includes a recessed area on a surface of the means for housing.

19. The jumper connector of claim 14, wherein a portion of the means for gripping is generally rectangular in shape.

20. The jumper connector of claim 14, further comprising a means for identifying configured to show the user what position the means for switching are in.

* * * * *